United States Patent [19]

Sano et al.

[11] 4,324,168

[45] Apr. 13, 1982

[54] WEAPON FIRING SYSTEM INCLUDING WEAPON INTERROGATION MEANS

[75] Inventors: Frank M. Sano, Wayne; Robert A. Sliwa, Woodcliff Lake; Edward J. Golden, Hartyston Township, Sussex County, all of N.J.

[73] Assignee: The Bendix Corporation, Teterboro, N.J.

[21] Appl. No.: 191,642

[22] Filed: Sep. 26, 1980

[51] Int. Cl.[3] ..... F41F 3/04

[52] U.S. Cl. ..... 89/1.814; 102/215

[58] Field of Search ..... 89/1.814, 1.813, 1.5 E; 102/215, 217, 206

[56] References Cited

U.S. PATENT DOCUMENTS

| | | | |
|---|---|---|---|
| 3,499,363 | 3/1970 | Lauro | 89/1.814 X |
| 3,598,015 | 8/1971 | Delistovich et al. | 89/1.814 |
| 3,735,668 | 5/1973 | Langlois et al. | 89/1.814 |
| 3,748,955 | 7/1973 | Gatermann et al. | 89/1.814 |
| 4,103,585 | 8/1978 | Foley | 89/1.814 |

*Primary Examiner*—David H. Brown

*Attorney, Agent, or Firm*—Anthony F. Cuoco; Vett Parsigian

[57] ABSTRACT

A weapon firing system including weapon interrogation means is disclosed wherein a weapon control computer (8) provides a signal (at 27) for closing a normally open switch (16) and signals (at 29, 29A, 29B, 29N) for connecting one of a plurality of weapon select relays (18, 18A, 18B, 18N) to the switch. During weapon interrogation, a low level interrogation signal (from 20) is applied through the closed switch and the one relay to a weapon igniter (12, 12A, 12B, 12N) connected to a corresponding weapon (2, 2A, 2B, 2N) to interrogate the availability of the weapon for firing. The igniter provides an impedance indicative of said availability which is sensed by a sensor (28) for providing a signal ($E_L$) which is applied to the computer for mission programming and display purposes. During weapon firing a fire signal (from 32) is applied through the closed switch and one of the relays connected to the switch to fire the weapon connected to the relay in a firing sequence depending on the availability of the weapons.

9 Claims, 1 Drawing Figure

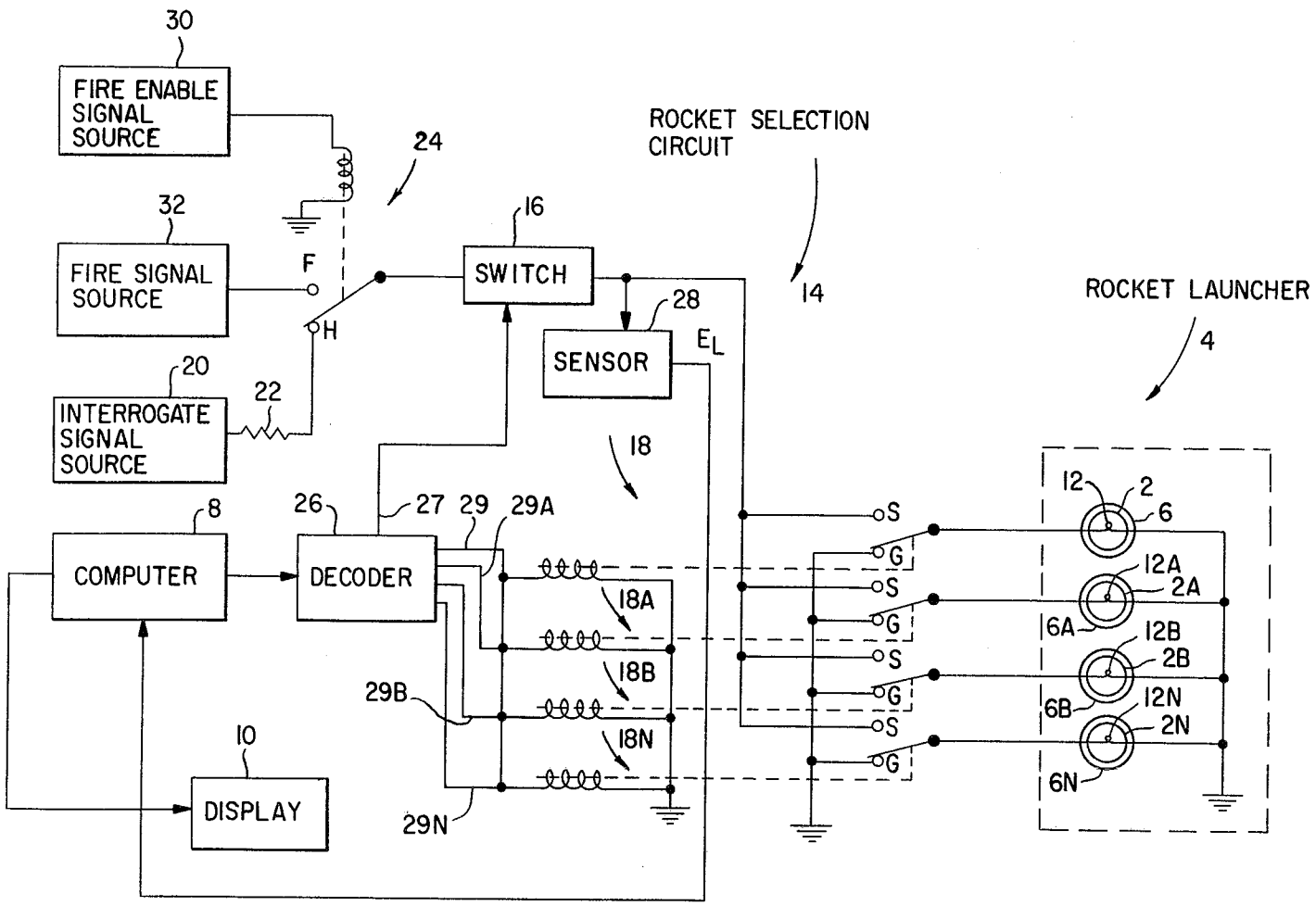
ROCKET LAUNCHER
4
ROCKET SELECTION CIRCUIT
14
SENSOR
28
$E_L$
SWITCH
16
24
F
H
18
18A
18B
18N
29A
29
29B
29N
27
DECODER
26
22
30
FIRE ENABLE SIGNAL SOURCE
32
FIRE SIGNAL SOURCE
20
INTERROGATE SIGNAL SOURCE
8
COMPUTER
10
DISPLAY
2
6
12
2A
12A
6A
2B
12B
6B
2N
12N
6N
S
G

WEAPON FIRING SYSTEM INCLUDING WEAPON INTERROGATION MEANS

BACKGROUND OF THE INVENTION

This invention relates to a system for electrically firing a plurality of weapons such as rockets carried by a rocket launcher on a military helicopter or other military vehicle, and including interrogation means for determining the availability of rockets ready to be fired.

Rocket firing systems of the type described include an electrically operable igniter associated with each rocket. The igniter is in the form of an electrical filament or resistance element which is heated by the passage of a firing current through the igniter. The heat is sufficient to fire means which ignites the propulsion charge of the rocket. The igniters are connected to a firing circuit which includes a firing lead connected to one side of the igniters with the other side thereof connected to ground. The firing lead of each rocket is connected by suitable circuitry to firing control means, whereby a firing signal is applied to each firing lead under the control of an operator.

It is advantageous to include interrogation means in the system for providing information relating to the availability of rockets ready to be fired, and to feed this information to a computer for mission programming and display purposes.

Prior art systems of the type described, such as particularly described in U.S. Pat. No. 4,103,585, issued to Nelson D. Foley on Aug. 1, 1978, and assigned to BEI Electronics, Inc., Little Rock, Arkansas, feature a plurality of rocket firing circuits connected to respective igniters of a plurality of rockets. A plurality of switching devices are connected to respective firing circuits and a plurality of signal circuits are connected between a signal source and respective switching devices. Each signal circuit includes indicating means for indicating the presence or absence of a signal current between a signal source and a corresponding igniter.

The present invention is an improvement over the prior art device in that it features a single firing circuit, a single signal circuit and a single indicating means to provide a more accurate, more reliable and more economical system. Further, the device of the present invention functions so that only one rocket can be fired at a time and it is not subject to actuation by spurious electromagnetic interferences as may be the case with prior art systems.

SUMMARY OF THE INVENTION

This invention contemplates a weapon firing system including weapon interrogation means, and utilizing common circuitry for the firing and interrogation functions. A weapon control computer applies a signal for actuating one of a plurality of weapon select relays for connecting the relay arm to a normally open switch. The relay is latched in this state while the computer applies a signal for closing the switch which applies a signal to an igniter connected to the relay arm to interrogate the weapon connected to the igniter. The igniter provides a impedance which is indicative of the availability of a weapon ready to be fired.

A sensor senses the impedance and applies a corresponding signal to the computer which stores the signal. The computer applies a signal for restoring the relay to its initial state and applies a signal for opening the switch. This sequence is repeated until each of the plurality of weapons is interrogated. The computer utilizes the stored signals to formulate a firing program sequence and to apply signals to a display device for displaying the results of the weapon interrogation.

The computer applies signals for closing the switch and for connecting the arm of one of the relays to the switch, whereby a firing signal is applied to corresponding weapon igniter. The firing signal is of sufficient magnitude to fire the igniter and hence the weapon associated therewith in accordance with the programmed sequence.

DESCRIPTION OF THE DRAWINGS

The single FIGURE in the drawing is an electrical schematic-block diagram showing a system according to the invention.

DETAILED DESCRIPTION OF THE INVENTION

The system illustrated in the drawing is, by way of example, applied to firing a plurality of rockets designated as 2, 2A, 2B and 2N adapted to be fired from a rocket launcher 4 such as carried by a helicopter or other military vehicle. Rocket launcher 4 has a corresponding plurality of rocket launching tubes designated as 6, 6A, 6B and 6N.

While only four rockets and associated rocket launching tubes are shown for illustration purposes, rocket launcher 4 may carry more launching tubes 6, which may in turn carry rockets of several different types. Further, groups of launching tubes 6 may be disposed in different zones of rocket launcher 4 with rockets of various types carried in the different zones.

With the present invention, an inventory may be taken of rockets 2, 2A, 2B and 2N on a current basis by a computer 8 having a display 10 indicating the number of rockets of each type which remain in rocket launcher 4 and are available for firing. An operator can read the display at any time to determine the number of rockets at his disposal. Computer 8 can also be arranged to provide a sequence for the firing of any desired number of rockets of each type. Computer 8 may be, for purposes of illustration, a microprocessor of the type manufactured by the Intel Corporation and carrying their designation Model 8085.

Each rocket 2, 2A, 2B and 2N has a corresponding igniter 12, 12A, 12B and 12N, respectively, which may be in the form of a small electrical filament or resistance heating element which is heated by the passage of an electrical current therethrough. The heat generated by the igniter ignites a charge which in turn ignites the propulsion charge of the respective rocket 2, 2A, 2B and 2N for firing the rocket.

Each igniter 12, 12A, 12B and 12N is connected to a common rocket selection circuit 14 including a normally open electronic switch 16 which may be a conventional type field effect transistor, and relays 18, 18A, 18B and 18N. One leg (the firing leg) of each of the igniters 12, 12A, 12B and 12N is connected to the arm of a corresponding relay 18, 18A, 18B and 18N, while the other leg of each of the igniters is connected to a common ground.

Rocket interrogation is accomplished when a signal from an interrogate signal source 20 is applied through a resistor 22 and a relay 24 having its arm in a position H so as to connect the interrogate signal source to switch 16. Upon operator initiation of the interrogation sequence via computer 8, the computer provides a coded rocket selection signal which is applied to a decoder 26. Decoder 26, which may be a series of conventional logic gates, decodes the coded signal and provides an output signal at an output line 27 and an output signal at an output line 29, for example. The signal at line 27 is effective for closing switch 16 and the signal at line 29 is effective for energizing relay 18 to displace the relay arm from a safe power ground position G to a position S connecting the relay arm to now closed switch 16.

Switch 16 passes the interrogate signal from interrogate signal source 20 applied through resistor 22 as aforenoted to activate igniter 12 of rocket 2. The value of resistor 22 is such that the igniter activating signal is much below the magnitude/time specified for "safety" or non-firing of the rocket.

Upon receipt of the interrogation signal, igniter 12 presents an impedance to switch 16. An impedance of infinity indicates that rocket ignitor 12 is open or that a rocket is not available in launching tube 6 of weapon launcher 4. An impedance in the magnitude of 10 ohms or less, for example, indicates that a valid rocket ignitor is present and a rocket is available in the designated launching tube. Hence, a voltage/current relationship is established by the igniter, with its magnitude being dependent upon the impedance value of the ignitor.

A sensor circuit 28, which may be a conventional type transistor circuit, is connected across the output of switch 16 and senses the aforenoted impedance to apply a logic output response signal $E_L$ to computer 8 indicating the availability status of rocket 2 for the particular interrogation interval. Computer 8 stores the information in memory and transmits a reset signal to decoder 26 for providing signals at output lines 27 and 29 which are now effective for opening switch 16 and for restoring relay 18 to its initial state, i.e., the relay arm in position G, respectively.

Computer 8 applies coded signals to decoder 26 which provides signals at output line 27 and at output lines 29A, 29B and 29N for sequentially interrogating rockets 2A, 2B and 2N as heretofore explained until each rocket has been so interrogated. The computer uses the stored information resulting from the interrogation to formulate a firing order program and to display the correct quantity of rockets available for firing on display device 10.

With rockets 2A, 2B and 2N interrogated as described, the rockets available for firing may be fired in a predetermined firing sequence as determined by computer 8.

Upon operator initiation of the firing sequence via computer 8, the computer provides a signal which is applied to decoder 26. Decoder 26 decodes the signal and provides a signal at output line 27 for closing open switch 16 and provides, for example, a signal at output line 29 which actuates relay 18 for displacing the relay arm from position G to position S, whereby rocket igniter 12 is connected to switch 16 as is the case during rocket interrogation.

A fire enable signal source 30 is operator-operated for actuating relay 24 whereupon the relay arm is displaced from position H to position F to apply a fire signal from a fire signal source 32 through closed switch 16 and the relay arm of relay 18 to igniter 12 to ignite the igniter and fire rocket 2.

Decoder 26 is responsive to a signal from computer 8 for providing a signal at output line 27 to open switch 16 and for providing a signal at output line 29 to actuate relay 18 to return the relay arm to its initial ground position, whereupon the decoder provides a signal at output line 27 for closing the switch and provides signals at output lines 29, 29A, 29B as the case may be, for effecting the firing of available rockets 2A, 2B and 2N as heretofore described. During the firing sequence sensor 28 is ineffective and any signal $E_L$ provided thereby is ignored by computer 8.

What is claimed is:

1. A weapon firing system including weapon interrogation means, comprising:

a plurality of weapons each of which has an electrical igniter;

switching means;

a plurality of switching devices connected to corresponding electrical igniters;

means for providing a weapon interrogate signal connected to the switching means and applying said signal thereto;

means for providing connecting signals and for applying said signals to the switching devices for independently connecting said devices to the switching means;

operating means connected to the switching means for rendering said means operative to apply the interrogate signal to an independently connected switching device and therethrough to a corresponding igniter for interrogating the availability of a weapon ready to fire;

a sensor connected to the switching means and connected through the independently connected switching device to the corresponding igniter for sensing the impedance thereof provided in response to the applied interrogate signal, said impedance being indicative of the availability of a weapon ready to fire;

means for providing a weapon firing signal;

means operative for disconnecting the switching means from the weapon interrogate signal means and for connecting said switching means to the weapon firing signal means, whereupon the firing signal is applied to the switching means; and the operating means rendering the switching means operative to apply the firing signal to an independently connected switching device and therethrough to the igniter for firing a corresponding weapon.

2. A weapon firing system including weapon interrogation means described by claim 1, wherein:

each of the electrical igniters has one arm connected to a corresponding switching device and another arm connected to a common ground.

3. A weapon firing system including weapon interrogation means as described by claim 1, wherein:

the switching means is normally open; and the operating means provides a signal which is applied to the switching means for rendering said switching means closed.

4. A weapon firing system including weapon interrogation means as described by claim 1, wherein:

each of the plurality of switching devices includes a relay having an arm connected to ground; and the means for providing connecting signals and for applying said signals to the switching devices for independently connecting said devices to the switching means applies said signals to disconnect the relay arm from ground and to connect said arm to the switching means.

5. A weapon firing system including weapon interrogation means as described by claim 1, including:

the sensor responsive to the sensed impedance of an igniter for providing a signal indicative of the availability of a weapon ready to fire; and means connected to the sensor for utilizing the signal therefrom.

6. A weapon firing system including weapon interrogation means as described by claim 1, including:

a relay connected to the switching means and having an arm connected to the interrogate signal means whereby the weapon interrogate signal is applied to the switching means;

the means operative for disconnecting the switching means from the weapon interrogate signal means and for connecting said switching means to the weapon firing signal means includes a signal source for providing a signal which actuates the relay arm to disconnect the arm from the weapon interrogate signal means and for connecting said arm to the weapon firing signal means, whereupon the firing signal is applied to the switching means.

7. A weapon firing system including weapon interrogation means as described by claim 1, wherein the means for providing connecting signals and for applying said signals to the switching devices for independently connecting said devices to the switching means includes:

means for providing coded signals in a predetermined sequence; and means for decoding said sequential signals and for applying the decoded sequential signals for independently connecting said devices to the switching means in the predetermined sequence.

8. A weapon firing system including weapon interrogation means as described by claim 7, wherein the operating means connected to the switching means for rendering said means operative to apply the interrogate signal to an independently connected switching device and therethrough to a corresponding igniter for interrogating the availability of a weapon ready to fire includes:

the means for providing coded signals in a predetermined sequence providing another coded signal whenever one of the sequential coded signals is provided; and the means for decoding said sequential signals decoding the other coded signal and applying said other decoded signal to the switching means whenever one of the decoded sequential signals is applied to the switching device for independently connecting said devices to the switching means for interrogating the availability of a weapon ready to fire.

9. A weapon firing system as described by claim 7, wherein the operating means rendering the switching means operative to apply the firing signal to an independently connected switching device and therethrough to the igniter for firing a corresponding weapon includes:

the means for providing coded signals in a predetermined sequence providing another coded signal whenever one of the sequential coded signals is provided; and the means for decoding said sequential signals decoding the other coded signal and applying said other decoded signal to the switching means whenever one of the decoded sequential signals is applied to the switching devices for independently connecting said devices to the switching means for firing a weapon.

* * * * *